US006031504A

United States Patent [19]

McEwan

[11] Patent Number: 6,031,504

[45] Date of Patent: Feb. 29, 2000

[54] BROADBAND ANTENNA PAIR WITH LOW MUTUAL COUPLING

[76] Inventor: Thomas E. McEwan, 1734 Cairo St., Livermore, Calif. 94550

[21] Appl. No.: 09/090,029

[22] Filed: Jun. 10, 1998

[51] Int. Cl.[7] ..... H01Q 13/02

[52] U.S. Cl. ..... 343/786; 343/772

[58] Field of Search ..... 343/786, 772, 343/789; H01Q 13/02

[56] References Cited

U.S. PATENT DOCUMENTS

| | | | |
|---|---|---|---|
| 2,719,230 | 9/1955 | Smoll et al. | 250/33.63 |
| 3,325,817 | 6/1967 | Ajioka et al. | 343/779 |
| 3,434,147 | 3/1969 | Cabion et al. | 343/756 |
| 3,836,976 | 9/1974 | Monser et al. | 343/795 |
| 4,001,834 | 1/1977 | Smith | 343/754 |
| 4,012,741 | 3/1977 | Johnson | 343/700 MS |
| 4,051,477 | 9/1977 | Murphy et al. | 343/700 MS |
| 4,083,046 | 4/1978 | Kaloi | 343/700 MS |
| 4,084,162 | 4/1978 | Dubost et al. | 343/700 MS |
| 4,376,940 | 3/1983 | Miedama | 343/840 |
| 4,467,294 | 8/1984 | Janky et al. | 333/126 |
| 4,485,385 | 11/1984 | Ralston | 343/795 |
| 4,513,292 | 4/1985 | Bowman | 343/795 |
| 4,843,403 | 6/1989 | Lalezari et al. | 343/767 |
| 4,853,704 | 8/1989 | Diaz et al. | 343/767 |
| 5,036,335 | 7/1991 | Jairam | 343/767 |
| 5,070,340 | 12/1991 | Diaz | 343/767 |
| 5,081,466 | 1/1992 | Bitter, Jr. | 343/767 |
| 5,229,777 | 7/1993 | Doyle | 343/700 MS |
| 5,274,391 | 12/1993 | Connolly | 343/820 |
| 5,404,146 | 4/1995 | Rutledge | 343/720 |
| 5,434,581 | 7/1995 | Reguenet et al. | 343/700 MS |
| 5,477,233 | 12/1995 | Hemming et al. | 343/767 |
| 5,479,180 | 12/1995 | Lenzing et al. | 343/729 |
| 5,568,159 | 10/1996 | Pelton et al. | 343/767 |
| 5,748,153 | 5/1998 | McKinzie, III et al. | 343/767 |
| 5,754,144 | 5/1998 | McEwan | 343/786 |

*Primary Examiner*—Don Wong
*Assistant Examiner*—Shih-chao Chen
*Attorney, Agent, or Firm*—Haynes & Beffel LLP

[57] ABSTRACT

A pair of adjacent antennas are configured to transmit and receive wideband signals with low direct coupling. The antennas are horns with extended walls and a shaped septum. At a typical operating frequency of 5.8 GHz, coupling levels are as low as −60 dB. Low coupling levels are needed to reduce measurement errors in radar rangefinders operating at less than 1-meter target range.

19 Claims, 5 Drawing Sheets

TOP VIEW

SIDE VIEW

APERTURE VIEW

TOP VIEW

SIDE VIEW

APERTURE VIEW

BROADBAND ANTENNA PAIR WITH LOW MUTUAL COUPLING

BACKGROUND OF THE INVENTION

1. Field of the Invention

The present invention relates to antennas, and more particularly to wideband antennas designed to reduce direct transmit-to-receive coupling effects for use in close range radars.

2. Description of Related Art

Pulse-echo radars are often used to measure range to a target, and recent high-resolution radars have emerged that are capable of centimeter range resolution at short ranges, e.g. on the order of meters. A particular problem with these radars is that they must receive echoes within a matter of nanoseconds after a pulse is transmitted when a target is very close, such as at 1-meter range or less.

If a transmitted pulse directly couples into the radar receiver, it will sum with echo signals to produce a range measurement error. In conventional radar systems, like airport radars, echo signals return many microseconds after direct-coupled pulses have passed and thus can be time gated out. At very short ranges, echoes return very quickly, often while a pulse is still being transmitted or while the antennas are ringing from the transmit pulse. At short ranges, close-in clutter or intercavity coupling effects are very pronounced since they occur right after the large transmit pulse, or main bang. Thus, it is highly desirable to minimize main-bang coupling between transmit and receive antennas in short-range radar applications. Further, strong main-bang pulses coupled into the receiver may create a receiver overload condition, blinding the receiver to nearby echoes.

Ideally, transmit-to-receive antenna coupling should be zero. Unfortunately, coupling between closely mounted antennas can be quite high, typically on the order of −20 dB for two side-by-side horns, and perhaps as great as −6 dB for adjacent dipoles or microstrip patches that are not shielded from each other.

Experiments show that direct antenna-to-antenna coupling must be on the order of −50 dB for radar rangefinders operating with 1-nanosecond wide RF bursts at 5.8 GHz and 1 mm range accuracy. An accuracy of 1 mm is required for tank level radars employed for "custody transfer" measurements—where the cost to fill a petroleum tanker truck from a large storage tank is based on a radar measurement and not a mechanical flowmeter.

U.S. Pat. No. 5,757,320 and U.S. patent application Ser. No. 08/451876 by McEwan describe short range, micropower impulse radars with a swept range gate. The transmit and receive antennas are contained in adjacent shielded cavities to reduce main bang coupling. Conductive or radiative (resistive) damping elements can be added to the cavities, or terminating plates can be attached to the cavity openings.

U.S. Pat. No. 5,754,144 to McEwan describes an ultra-wideband horn antenna with an abrupt radiator which is designed to reduce or eliminate close-in clutter effects. Lips extending from opposed edges of the horn aperture can be used to help launch or receive a clean pulse by controlling trailing pulse ringing due to horn rim effects.

There is essentially no prior art addressing suitable low-coupling antennas since high-accuracy short-range radar ranging is an emerging technology. Digital background subtraction circuits have been added at the output of radar devices to attempt to correct the output signal for coupling effects but are inconvenient to use in many applications. It would be far better to prevent the coupling instead of trying to correct for it.

SUMMARY OF THE INVENTION

Accordingly, it is an object of the present invention to provide a transmit-receive antenna pair with substantially reduced coupling.

Another object of the present invention is to provide a compact low-cost antenna pair for a wide variety of high-resolution radar rangefinder applications, such as tank level measurements, robotics, automotive safety, and general industrial and commercial ranging and object detection applications.

The present invention employs two wideband horns in an adjacent configuration that minimizes mutual coupling. Coupling is further reduced by tapered wall extensions with a length that defines a coupling null. Coupling is yet further reduced with a tapered septum located between the transmit and receive horns.

DETAILED DESCRIPTION OF THE INVENTION

A detailed description of the present invention is provided below with reference to the figures. While illustrative parameters are given, other embodiments can be constructed with other shapes and dimensions.

Figure 1A:
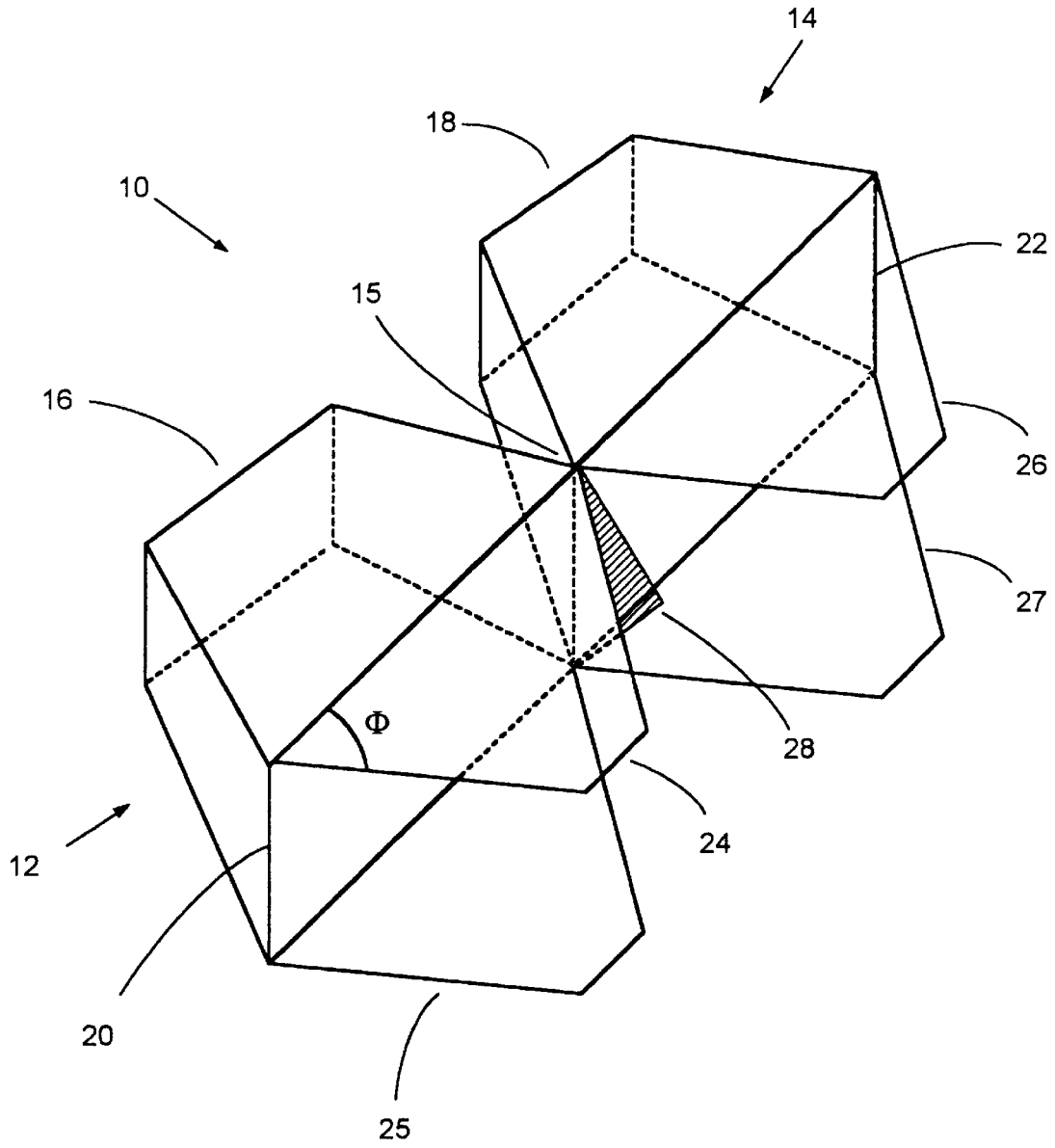
FIGS. 1*a, b, c* are perspective, side and aperture views of the antenna pair of the present invention showing the extended walls and shaped septum.

FIG. 1*a* is a perspective view of the antenna pair 10 of the present invention. Two horns 12, 14 are shown positioned side-by-side at junction 15. One horn is used as a transmit horn and one as a receive horn. The entire assembly may be constructed out of thin sheet metal such as 0.25 mm thick brass. Each horn 12, 14 has a narrower feedline end 16, 18 and a wider aperture end 20, 22 respectively. Horns 12, 14 are typically of rectangular cross-section, but may have other shapes.

Four tapered or truncated triangular pieces 24, 25, 26, 27 are shown extending from the top and bottom walls of the two horns 12, 14 at the aperture ends 20, 22. These tapered wall extensions 24–27 are very instrumental in reducing coupling. In addition, a triangular extension, or septum, 28 extends from the center of the assembly (junction 15).

Figure 1B:
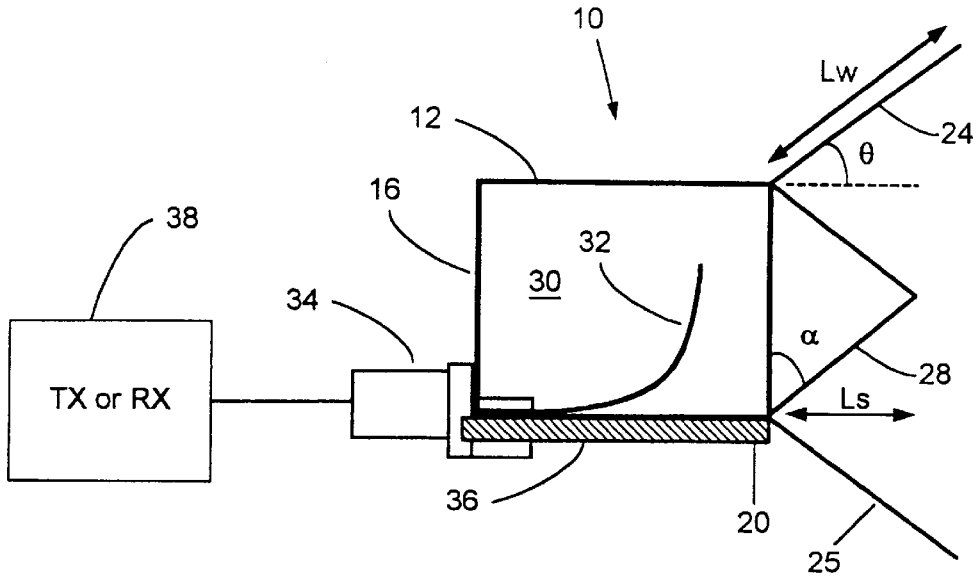
Figure 1C:
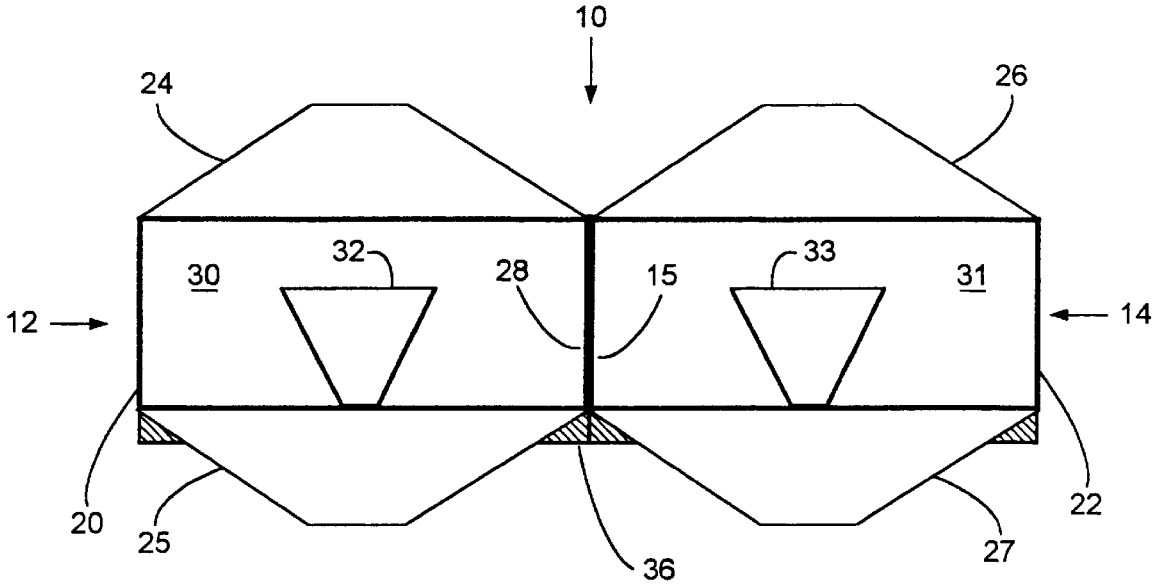

FIG. 1*b* is a side view of the antenna assembly 10 of FIG. 1*a*. In this view the lengths and angles of the wall extensions 24, 25 and the septum 28 are visible, as well as the horn cavity 30, a flared microstrip feed 32, an SMA connector 34, and a printed circuit board (PCB) 36 (which are not shown in FIG. 1*a*). FIG. 1*c* is an aperture end view of antenna assembly 10.

Horns 12, 14 are mounted on PCB 36 which forms the bottom wall thereof. A flared microstrip feed 32, 33 is mounted in the interior horn cavity 30, 31 of each horn antenna 12, 14. Antenna feeds 32, 33 are electrically connected to the outside (e.g. to a feedline) through SMA connectors 34 at feedline ends 16, 18 of horns 12, 14. Horn antennas 12, 14 are connected to a transmitter (TX) or receiver (RX) 38.

The length Lw of the wall extensions 24–27 is approximately $\lambda/2$, e.g., 2.5 cm for 5.8 GHz. The operational wavelength $\lambda$ from which the length is calculated is the wavelength of the RF signal applied to one antenna (the transmit antenna) and also the wavelength of the reflected RF signal received by the other antenna (the receive antenna). This length tunes the frequency (or wavelength $\lambda$) of least coupling between the two antennas, as seen by the minimum region in the lower plot of FIG. 4. The degree of taper $\phi$, e.g., 45°, is not particularly critical, nor is the angle $\theta$, e.g., 30°, from horizontal. Approximately optimum geometry is shown in FIGS. 1*a*–*c*.

The length Ls of the septum is approximately $\lambda/4$, e.g., 1.2 cm for 5.8 GHz. This length also tunes the frequency of least coupling between the two antennas. The degree of septum taper $\alpha$, e.g., 45°, is not particularly critical, and is shown with approximately optimum geometry in FIGS. 1*a* and 1*b*.

Figure 2A:
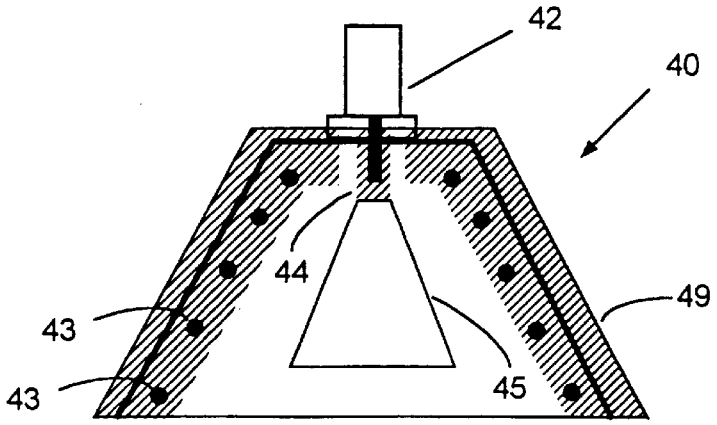
FIGS. 2*a, b, c* are top, side, and aperture views of a basic horn with a preferred broadband feed.
Figure 2B:
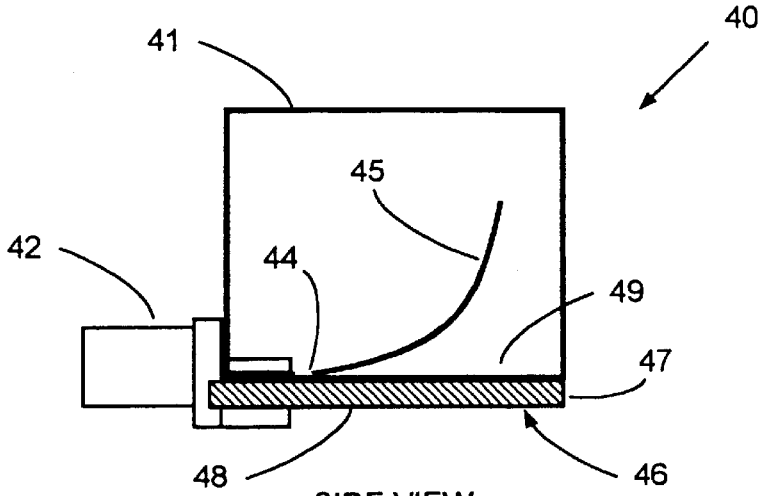
FIGS. 2*d, e, f* are top, side, and aperture views of a basic horn with an alternative monopole feed.
Figure 2C:
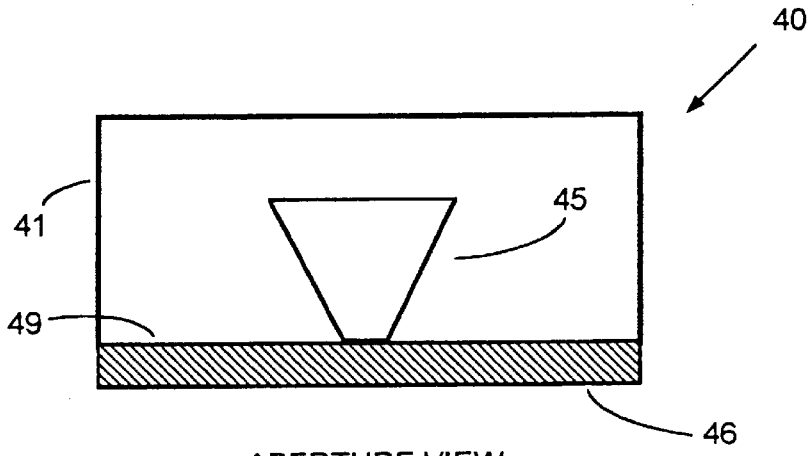

FIGS. 2*a*–*c* depict a basic horn antenna 40 as incorporated in the present invention, without the wall extensions and septum. An SMA RF connector 42 attaches to a microstrip 44 residing on a PCB 46. The PCB 46 used for a 5.8 GHz embodiment is ~1.5 mm thick glass-epoxy layer 47 with a solid copper foil 48 on the bottom side and a foil 49 etched away in the center as shown in FIG. 2*a* on the top side for a microstrip 44 and for grounds. A sheet metal horn 41 is soldered to the top foil 49. The top foil 49 connects to the bottom foil 48 through ground vias 43.

Figure 2D:
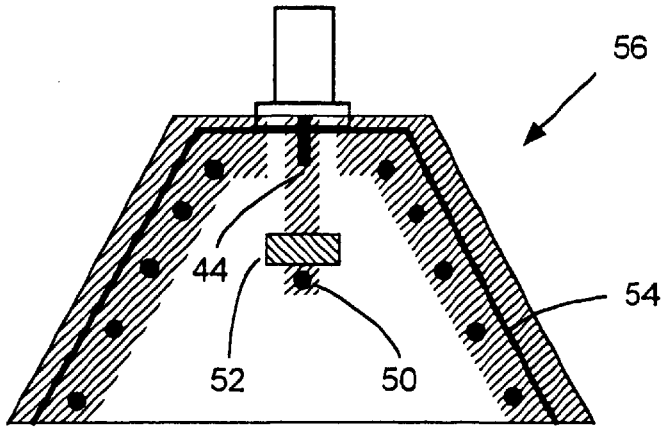
Figure 2E:
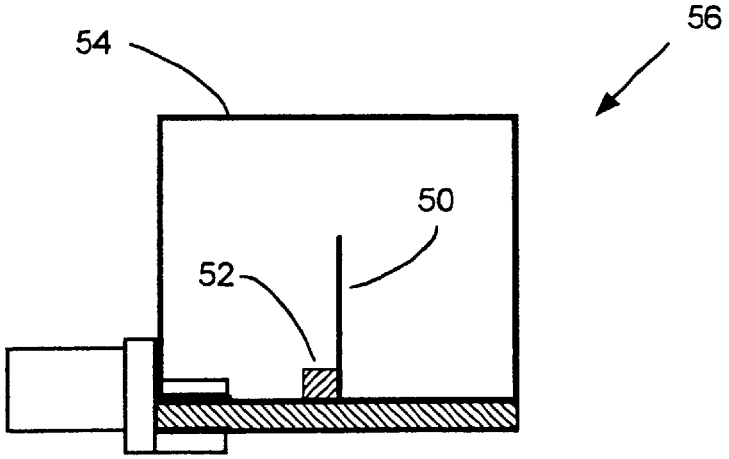
Figure 2F:
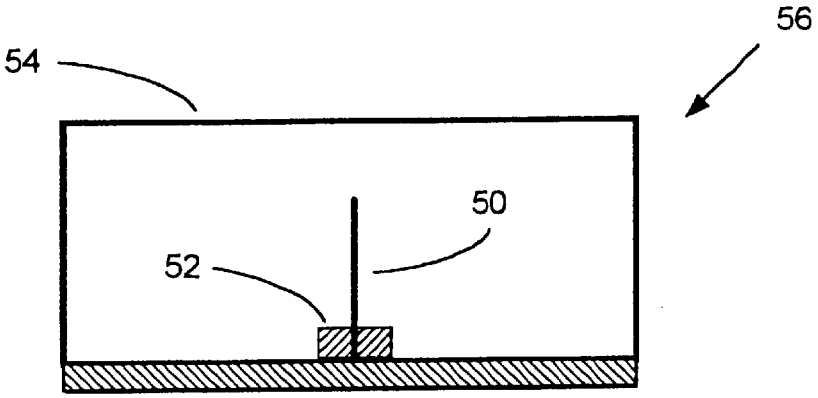

The 50 Ω microstrip 44 connected to the SMA 42 is routed into the horn 41 and then connected to an upwardly flaring tapered radiator 45. The flared radiator 45 exhibits a wide impedance bandwidth and efficient radiation across a broad band. Alternatively, the microstrip 44 may be connected to a vertical wire monopole 50, cut to a length of $\lambda/4$ at the operating frequency as shown in FIGS. 2*d*–*f*. In some compact, low-cost applications, it is advantageous to locate the transmit or receive RF circuitry 52 inside the horn 54 of antenna 56, where the circuitry 52 directly couples to the monopole 50.

Figure 3:
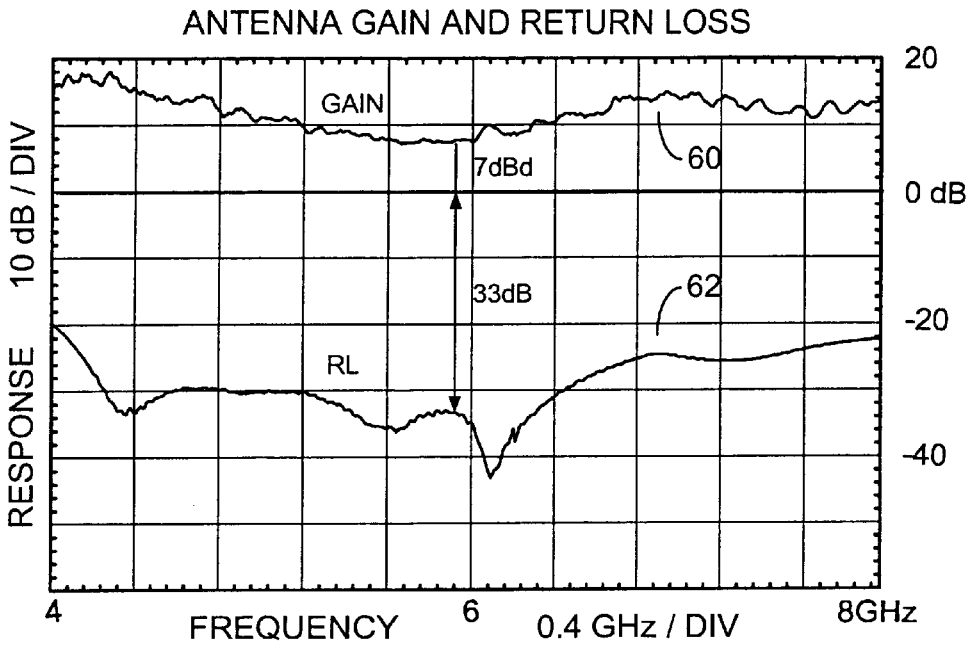
FIG. 3 Hots gain and return loss for one of the horns in FIG. 1*a*, with responses at 5.8 GHz indicated.

FIG. 3 illustrates the performance of the antenna of FIGS. 2*a*–*c* when embodied in the complete invention of FIGS. 1*a*–*c*. The upper trace 60 plots the gain of the antenna relative to a 5.8 GHz dipole. The gain is seen to be 7 dBd, relative to a dipole. Since a dipole has 1.6 dB gain relative to isotropic, the horn antenna has 8.6 dB gain relative to isotropic and about 60 degrees beamwidth at 5.8 GHz. Its dimensions are 5×2×2.5 cm width, height and depth, respectively.

The lower plot 62 of FIG. 3 shows the return loss RL for the antenna of FIGS. 1*a*–*c*. The RL is greater than −20 dB across the 4–8 GHz band, indicating an excellent VSWR of 1.2:1 or less across the band.

Figure 4:
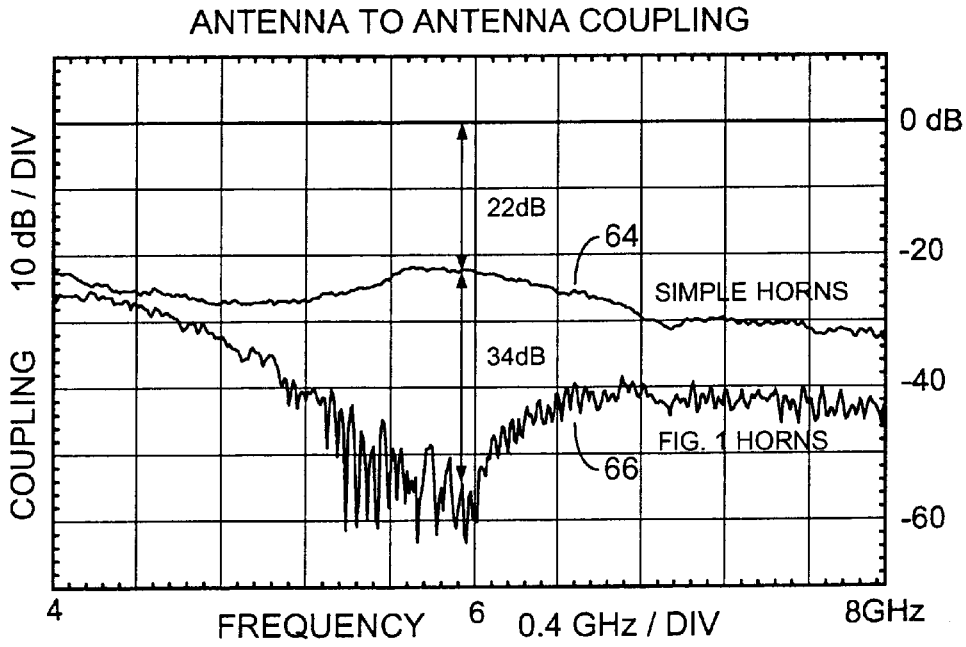
FIG. 4 plots the coupling between two adjacent horns of the type shown in FIGS. 2*a–c* (upper plot) and the coupling level between the horns shown in FIG. 1*a* (lower plot), with responses at 5.8 GHz indicated.

The upper plot 64 in FIG. 4 shows the direct coupling level observed when two horns of FIGS. 2*a*–*c*, without the wall extensions and septum, are placed side-by-side. At 5.8 GHz the coupling is −22 dB, inadequate for high accuracy rangefinders. If the two horns are stacked on top of each other, the coupling degrades to about −10 dB.

The lower plot 66 in FIG. 4 shows the much-reduced coupling level when the wall extensions and septum are added to the horns as shown in FIGS. 1*a*–*c*. The least amount of coupling is about −56 dB. The lengths of the wall extensions and the septum set the frequency of minimum coupling, and have been tuned for 5.8 GHz. The detailed structure seen around 5.8 GHz is due to room reflections-the direct coupling is less than reflections from a gypsum wall at 3-meters range.

Changes and modifications in the specifically described embodiments can be carried out without departing from the scope of the invention which is intended to be limited only by the scope of the appended claims.

What is claimed is:

1. An antenna pair with low direct coupling therebetween, comprising:

first and second adjacent horns, each having an internal feed, and each having upper and lower walls, first and second tapered wall extensions attached to the upper and lower walls of each of the first and second horns, the tapered wall extensions having a length which defines a coupling null.

2. The antenna pair of claim 1 where the tapered wall extensions are approximately $\lambda/2$ long at the frequency of an RF signal applied to one of the antennas.

3. The antenna pair of claim 1 further including a septum extending from the center of the antenna pair approximately $\lambda/4$ at the frequency of an RF signal applied to one of the antennas.

4. The antenna pair of claim 3 where the septum is tapered.

5. The antenna pair of claim 1 where the internal feed is a flared microstrip.

6. The antenna pair of claim 1 where the internal feed is a monopole.

7. The antenna pair of claim 1 wherein one horn is a transmit horn and the other horn is a receive horn.

8. The antenna pair of claim 7 further comprising a transmitter connected to the internal feed of the transmit horn and a receiver connected to the internal feed of the receive horn.

9. The antenna pair of claim 1 wherein the first and second horns are formed of sheet metal.

10. The antenna pair of claim 9 further comprising a printed circuit board (PCB) on which the first and second horns are mounted.

11. The antenna pair of claim 10 further comprising a microstrip residing on the PCB in each horn and connected to the internal feed therein, and an electrical connector connected to each microstrip and extending out of each horn for external electrical connection.

12. The antenna pair of claim 11 wherein the PCB comprises a glass-epoxy layer, a solid metal layer on one side of the glass-epoxy layer, and an etched metal layer on the other side of the glass-epoxy layer, the horns being attached to the etched metal layer.

13. The antenna pair of claim 12 further comprising a plurality of vias connecting the etched metal layer to the solid metal layer through the glass-epoxy layer.

14. The antenna pair of claim 13 wherein the solid metal layer forms a ground layer.

15. The antenna pair of claim 1 wherein the wall extensions have a taper angle of about 45°.

16. The antenna pair of claim 1 wherein the wall extensions extend upwardly and downwardly at an angle of about 30° from the normal to the horn aperture.

17. The antenna pair of claim 4 wherein the septum has a taper angle of about 45°.

18. The antenna pair of claim 1 wherein the horns have a rectangular cross-section.

19. An antenna pair with direct coupling of about −50 dB or less therebetween, comprising:

first and second adjacent horns, each having an internal feed, and each having upper and lower walls, first and second tapered wall extensions attached to the upper and lower walls of each of the first and second horns, the tapered wall extensions having a length which defines a coupling null, a septum extending from the center of the antenna pair and having a length which also defines a coupling null.

* * * * *